US005199626A

United States Patent [19]

Terayama et al.

[11] Patent Number: 5,199,626

[45] Date of Patent: Apr. 6, 1993

[54] COMBUSTION GAS POWERED TOOL

[75] Inventors: Tsunehisa Terayama, Katsuta; Takuji Torii, Ushiku; Shinki Ohtsu, Ibaraki; Hiromu Utsumi, Katsuta; Teruo Suzuki, Hitachi; Toshifumi Kubota, Katsuta; Yo Kawakami, Mito; Yasuyuki Hirano, Katsuta; Akira Uno, Hitachioota, all of Japan

[73] Assignee: Hitachi Koki Company Limited, Tokyo, Japan

[21] Appl. No.: 888,307

[22] Filed: May 27, 1992

Related U.S. Application Data

[63] Continuation of Ser. No. 769,257, Oct. 1, 1991, abandoned.

[30] Foreign Application Priority Data

Oct. 5, 1990 [JP] Japan ..... 2-269145

[51] Int. Cl.[5] ..... B25C 1/08

[52] U.S. Cl. ..... 227/10; 227/8; 123/46 SC

[58] Field of Search ..... 227/9, 10, 8; 123/46 SC, 46 H

[56] References Cited

U.S. PATENT DOCUMENTS

| | | | |
|---|---|---|---|
| 4,200,213 | 4/1980 | Liesse | 123/46 SC X |
| 4,320,864 | 3/1982 | Novak et al. | 227/156 X |
| 4,483,473 | 11/1984 | Wagdy | 227/10 X |
| 4,483,474 | 11/1984 | Nikolich | 227/10 X |
| 4,522,162 | 6/1985 | Nikolich | 123/46 SC |
| 4,759,318 | 7/1988 | Adams | 123/46 SC |
| 4,773,581 | 9/1988 | Ohtsu et al. | 227/10 |
| 4,913,331 | 4/1990 | Utsumi et al. | 227/10 |
| 5,090,606 | 2/1992 | Torii et al. | 227/10 |

*Primary Examiner*—Frank T. Yost
*Assistant Examiner*—Clark F. Dexter
*Attorney, Agent, or Firm*—Pollock, VandeSande & Priddy

[57] ABSTRACT

A combustion gas powered tool includes a member defining a part of cylindrical combustion chamber having an axis. A piston is movable in a direction along the axis of the combustion chamber. The piston defines the combustion chamber in conjunction with the member. A mixture of air and fuel is generated in the combustion chamber. The air-fuel mixture in the combustion chamber is burned to drive the piston. An orifice grille extends in the combustion chamber, and is parallel to the axis of the combustion chamber.

5 Claims, 7 Drawing Sheets

COMBUSTION GAS POWERED TOOL

This application is a continuation of Ser. No. 07/769,257, filed on Oct. 1, 1991, now abandoned.

BACKGROUND OF THE INVENTION

1. Field of the Invention

This invention generally relates to a combustion gas powered tool, and specifically relates to a combustion gas powered fastener driving tool such as a combustion gas powered tacker or nailer.

2. Description of the Prior Art

U.S. Pat. No. 4,773,581 discloses a combustion gas powered tool or a combustion gas powered nailer which has grilles disposed in a cylindrical combustion chamber and extending perpendicular to the axis of the combustion chamber. The grilles serve to generate turbulences of an air-fuel mixture, promoting the combustion of the air-fuel mixture. In cases where an external fan is provided to smoothly scavenge burned gas from the combustion chamber, the grilles offer resistances to a flow of the burned gas. Therefore, the presence of the grilles causes an increased electric power of driving the fan. Since the fan driving power is supplied by a battery, the presence of the grilles causes a higher rate of the consumption of an electric power of the battery.

The combustion gas powered tool of U.S. Pat. No. 4,773,581 has communication holes extending through side walls of a cylinder. During a later stage of the movement of a piston from its top dead center to its bottom dead center, the burned gas is allowed to escape from the combustion chamber into atmosphere via the communication holes so that the pressure in the combustion chamber drops to an atmospheric level. Then, the gas remaining in the combustion chamber cools, and a vacuum occurs in the combustion chamber. After the piston reaches its bottom dead center, the vacuum in the combustion chamber helps the return of the piston to its top dead center.

SUMMARY OF THE INVENTION

It is an object of this invention to provide an improved combustion gas powered tool.

A first aspect of this invention provides a combustion gas powered tool comprising a member defining a part of a cylindrical combustion chamber having an axis; a piston movable in a direction along the axis of the combustion chamber, the piston defining the combustion chamber in conjunction with the member; means for generating a mixture of air and fuel in the combustion chamber; means for igniting the air-fuel mixture in the combustion chamber to drive the piston; and an orifice grille extending in the combustion chamber and being parallel to the axis of the combustion chamber.

A second aspect of this invention provides a combustion gas powered tool comprising a cylinder head; a cylinder movable into and from its normal position; a piston movably disposed in the cylinder and defining a combustion chamber in conjunction with the cylinder head and the cylinder, wherein the combustion chamber is closed and opened when the cylinder moves into and from its normal position respectively; means for generating a mixture of air and fuel in the combustion chamber; means for igniting the air-fuel mixture in the combustion chamber to drive the piston; and means for, when the piston approximately reaches its bottom dead center, moving the cylinder from its normal position to open the combustion chamber to scavenge a portion of burned gas from the combustion chamber and to drop a pressure within the combustion chamber to an atmospheric level; and means for returning the cylinder to its normal position to close the combustion chamber when the pressure within the combustion chamber is dropped to the atmospheric level; wherein, after the combustion chamber is closed, burned gas remaining in the combustion chamber cools and a vacuum occurs in the combustion chamber so that the piston is returned to its top dead center by the vacuum.

A third aspect of this invention provides a combustion gas powered tool comprising a member; a movable main piston defining a combustion chamber in conjunction with the member; means for generating a mixture of air and fuel in the combustion chamber; means for igniting the air-fuel mixture in the combustion chamber to drive the main piston; an auxiliary cylinder adjoining the combustion chamber and having an exhaust opening which can communicate with the combustion chamber; an auxiliary piston movably disposed in the auxiliary cylinder for selectively enabling and inhibiting a communication between the combustion chamber and the exhaust opening; and means for, when a pressure in the combustion chamber increases, moving the auxiliary piston to enable the communication between the combustion chamber and the exhaust opening.

A fourth aspect of this invention provides a combustion gas powered tool comprising a cylinder head defining a part of a cylindrical combustion chamber having an axis; a piston being movable in a direction along the axis of the combustion chamber and defining the combustion chamber in conjunction with the cylinder head; a partition wall extending in parallel with the axis of the combustion chamber and dividing the combustion chamber into first and second sub chambers, the partition wall having at least one orifice via which the first and second sub chambers communicate with each other; means for generating mixtures of air and fuel in the first and second sub chambers respectively; means for igniting the air-fuel mixture in the first sub chamber to burn the air-fuel mixture in the first sub chamber, wherein a pressure increase by burning of the air-fuel mixture force an unburned portion of the air-fuel mixture from the first sub chamber into the second sub chamber via the orifice, and the orifice functions to provide turbulences in the air-fuel mixture in the second sub chamber, and wherein burning of the air-fuel mixture propagates into the second sub chamber via the orifice; and means for supplying air to the first and second sub chambers and scavenging burned gas from the first and second sub chambers, the supplying and scavenging means including means for executing the air supplying and the burned-gas scavenging on the first sub chamber independently of the air supplying and the burned-gas scavenging on the second sub chamber so that the partition wall is prevented from providing a significant resistance to said supplying the air and said scavenging the burned gas.

A fifth aspect of this invention provides a combustion gas powered tool comprising a member defining a part of a combustion chamber; a piston movable in a predetermined direction and defining the combustion chamber in conjunction with the member; means for generating a mixture of air and fuel in the combustion chamber; means for igniting the air-fuel mixture in the combustion chamber to drive the piston; and an orifice grille extending in parallel with the predetermined direction of movement of the piston.

DESCRIPTION OF THE FIRST PREFERRED EMBODIMENT

Figure 1:
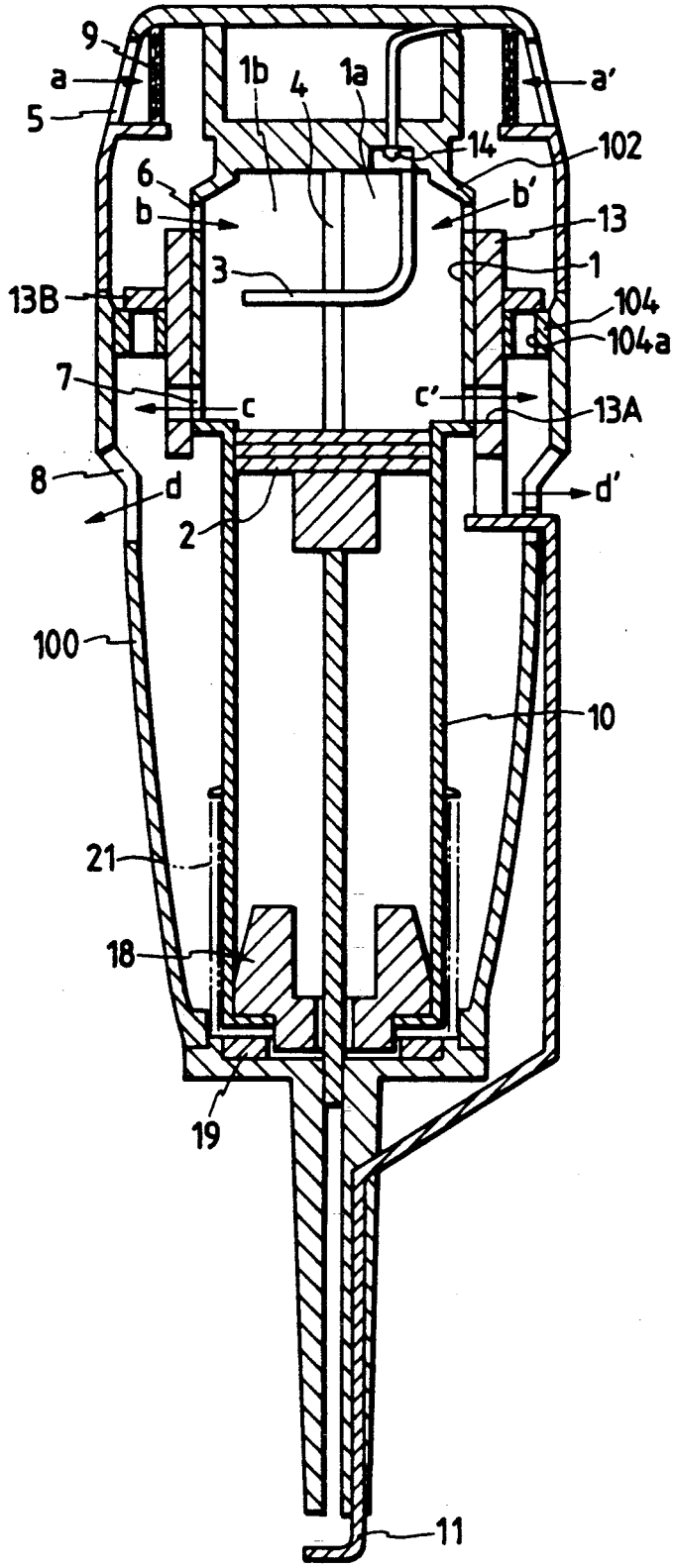
FIG. 1 is a longitudinal section view of a combustion gas powered nailer according to a first embodiment of this invention, which shows conditions where air is supplied and burned gas is scavenged before combustion occurs.
Figure 2:
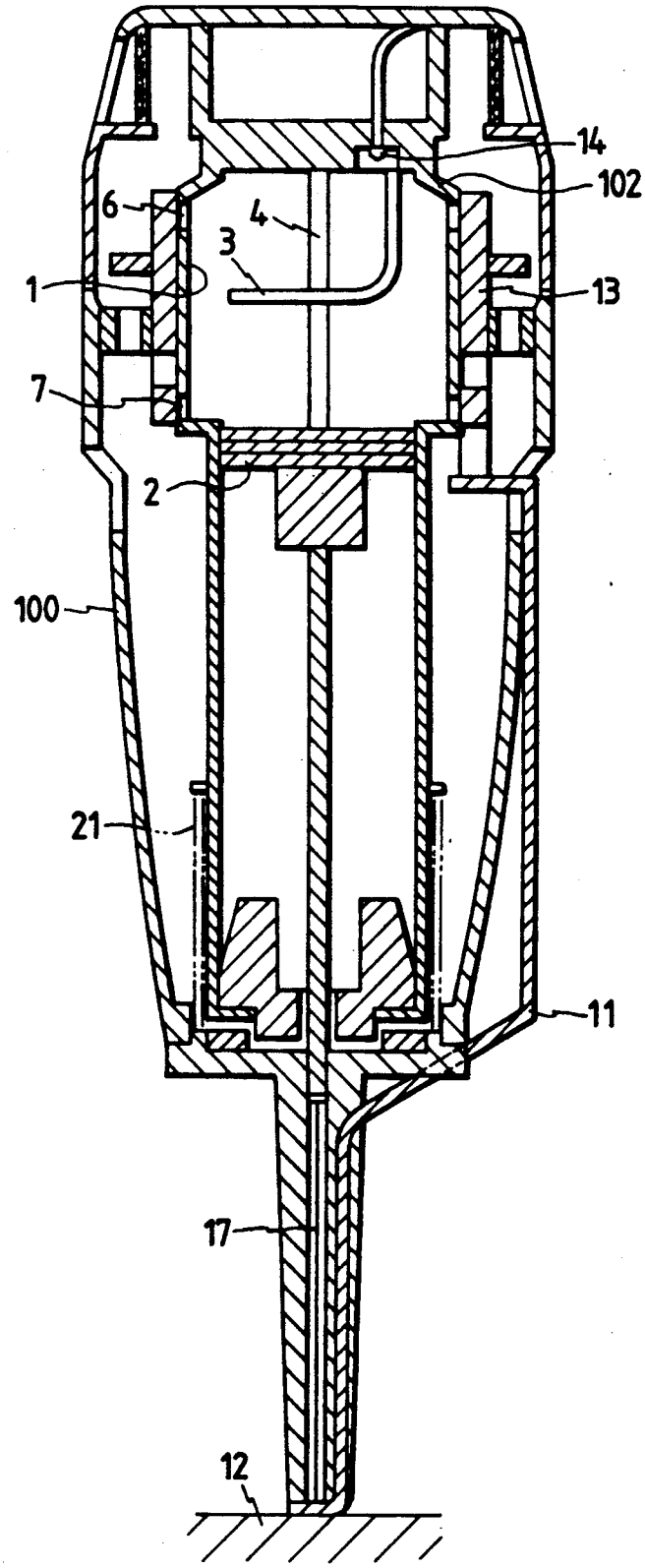
FIG. 2 is a longitudinal section view of the combustion gas powered nailer, which shows conditions where a combustion chamber is closed to start the combustion.

With reference to FIGS. 1 and 2, a combustion gas powered fastener driving tool or nailer includes a hollow cylindrical outer shell or housing 100 in which a hollow cylinder head 102 extends coaxially. The cylinder head 102 has a closed upper end and an open lower end. A cylinder 10 disposed coaxially in the housing 100 extends downward of the cylinder head 102. The cylinder 10 can move axially. A spring 21 provided between the cylinder 10 and the housing 100 urges the cylinder 10 toward the cylinder head 102. Thus, the cylinder 10 is normally held in a position at which an upper end of the cylinder 10 is connected to the open lower end of the cylinder head 102. A disc piston 2 is slidably disposed within the cylinder 10. The cylinder head 102, the cylinder 10, and the piston 2 define a combustion chamber 1.

Figure 3:
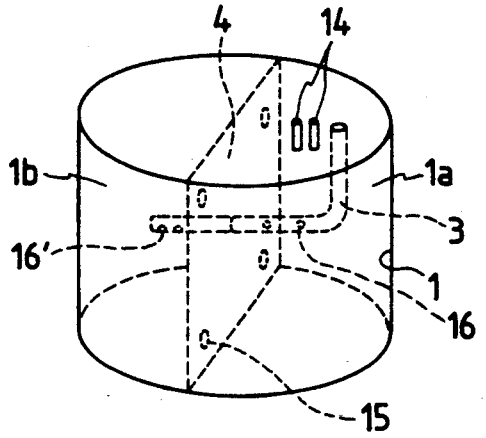
FIG. 3 is a perspective view of the combustion chamber and the members in the combustion chamber of FIGS. 1 and 2.

As shown in FIGS. 1–3, a vertically-extending partition wall 4 divides the combustion chamber 1 into right-hand and left-hand halves 1*a* and 1*b*. It should be noted that the partition wall 4 is also referred to as an orifice grille. A fuel injection nozzle or tube 3 extends from an upper wall of the cylinder head 102, passing through the right-hand half 1*a* of the combustion chamber 1 and the partition wall 4 and terminating at a central region within the left-hand half 1*b* of the combustion chamber 1. The fuel injection nozzle 3 has small fuel injection holes 16 and 16' exposed to the right-hand and left-hand halves 1*a* and 1*b* of the combustion chamber 1, so that fuel can be injected from the fuel injection nozzle 3 into both the right-hand and left-hand halves 1*a* and 1*b* of the combustion chamber 1 via the holes 16 and 16'.

As shown in FIGS. 1 and 2, an upper part of the side walls of the housing 100 has communication holes 5, and an intermediate part of the side walls of the housing 100 has communication holes 8. An upper part of the side walls of the cylinder head 102 has communication holes 6, and a lower part of the side walls of the cylinder head 102 has communication holes 7. Filters 9 are located inward of the communication holes 5 so that the filters 9 can act on air flowing through the communication holes 5.

A cylindrical communication control member 13 extends outward of the cylinder head 102 but inward of the housing 100. The communicatin control member 13 can slide on the cylinder head 102. A vertically-movable push lever 11 is supported on the housing 100. An upper end of the push lever 11 is connected to the communication control member 13. A lower end of the push lever 11 projects downward from a lower end of the housing 100. The communication control member 13 is moved in accordance with movement of the push lever 11. When the push lever 11 assumes its lowest position as shown in FIG. 1, the communication control member 13 opens the communication holes 6 and 7. For this purpose, the communication control member 13 has holes 13A which are in register with the communication holes 7 when the push lever 11 assumes its lowest position. In addition, the upper edge of the communication control member 13 lies downward of the communication holes 6 when the push lever 11 assumes its lowest position. When the push lever 11 assumes its highest position as shown in FIG. 2, the communication control member 13 blocks the communication holes 6 and 7.

An annular member 104 separates a space between the cylinder head 102 and the housing 100 into an upper part and a lower part, which can communicate with each other via passages 104*a* extending vertically through the annular member 104. The communication control member 13 has an outwardly-extending part 13B which serves to block and unblock the passages 104*a*. When the push lever 11 assumes its lowest position as shown in FIG. 1, the passages 104*a* are blocked by the outwardly-extending part 13B of the communication control member 13. When the push lever 11 moves up from its lowest position as shown in FIG. 2, the passages 104*a* are unblocked.

Burned gas is scavenged from the combustion chamber 1 as follows. As a scavenging fan (not shown) provided outside the combustion chamber 1 is activated, air flows into the housing 100 via the communication holes 5 as shown by the arrows a and a' in FIG. 1 and then moves through the filters 9. In addition, the air moves into the combustion chamber 1 via the communication holes 6 as shown by the arrows b and b' in FIG. 1. Further, air including burned gas, which result from a preceding combustion of an air-fuel mixture, moves from the combustion chamber 1 via the communication holes 7 as shown by the arrows c and c' in FIG. 1. Finally, the air including the burned gas exits from the interior of the housing 100 via the communication holes 8 as shown by the arrows d and d' in FIG. 1. As a result, fresh air fills the combustion chamber 1, and the burned gas is scavenged from the combustion chamber 1.

When the push lever 11 is pressed against a wooden workpiece 12 as shown in FIG. 2, the push lever 11 and the communication control member 13 are moved upward. As a result, the communication holes 6 and 7 are blocked by the communication control member 13, and the combustion chamber 1 is completely closed. In addition, when the push lever 11 is pressed against the wooden workpiece 12, a fuel metering section (not shown) is activated so that a metered quantity of fuel is injected into the combustion chamber 1. Thus, a mixture of the air and the fuel is generated in the combustion chamber 1. Then, a spark plug 14 exposed to the combustion chamber 1 is activated so that the airfuel mixture starts to burn.

Figure 4:
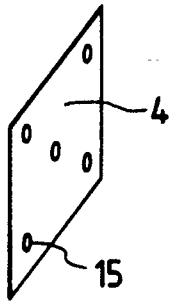
FIG. 4 is a perspective view of the orifice grille of FIGS. 1–3.

As shown in FIGS. 1-3, the partition wall 4 extends in parallel with the axis of the cylindrical combustion chamber 1. The combustion chamber 1 is divided into the right-hand and left-hand halves 1*a* and 1*b* by the partition wall 4. The partition wall 4 is composed of an orifice grille having small holes or orifices 15 as shown in FIGS. 3 and 4. The fuel injection nozzle 3 has the small fuel injection holes 16 and 16' exposed to the right-hand and left-hand halves 1*a* and 1*b* of the combustion chamber 1, so that the fuel is injected into both the right-hand and left-hand halves 1*a* and 1*b* of the combustion chamber 1. Since the spark plug 14 is exposed to the right-hand half 1*a* of the combustion chamber 1, the burning of the air-fuel mixture starts in the right-hand half 1*a* of the combustion chamber 1. The burning of the air-fuel mixture causes an expanded quantity of high-temperature burned gas, forcing unburned gas from the right-hand half 1*a* of the combustion chamber 1 into the left-hand half 1*b* of the combustion chamber 1 via the small holes 15 in the orifice grille 4. During this process, the small holes 15 provide turbulences of the unburned gas in the left-hand half 1*b* of the combustion chamber 1. The burning of the air-fuel mixture propagates into the left-hand half 1*b* of the combustion chamber 1. The previously-mentioned turbulences promote the combustion of the air-fuel mixture, and thus enable good combustion of the air-fuel mixture.

The combustion of the air-fuel mixture moves the piston 2 downward, driving a fastener or nail 17 (see FIG. 2) into the wooden workpiece 12.

Figure 6:
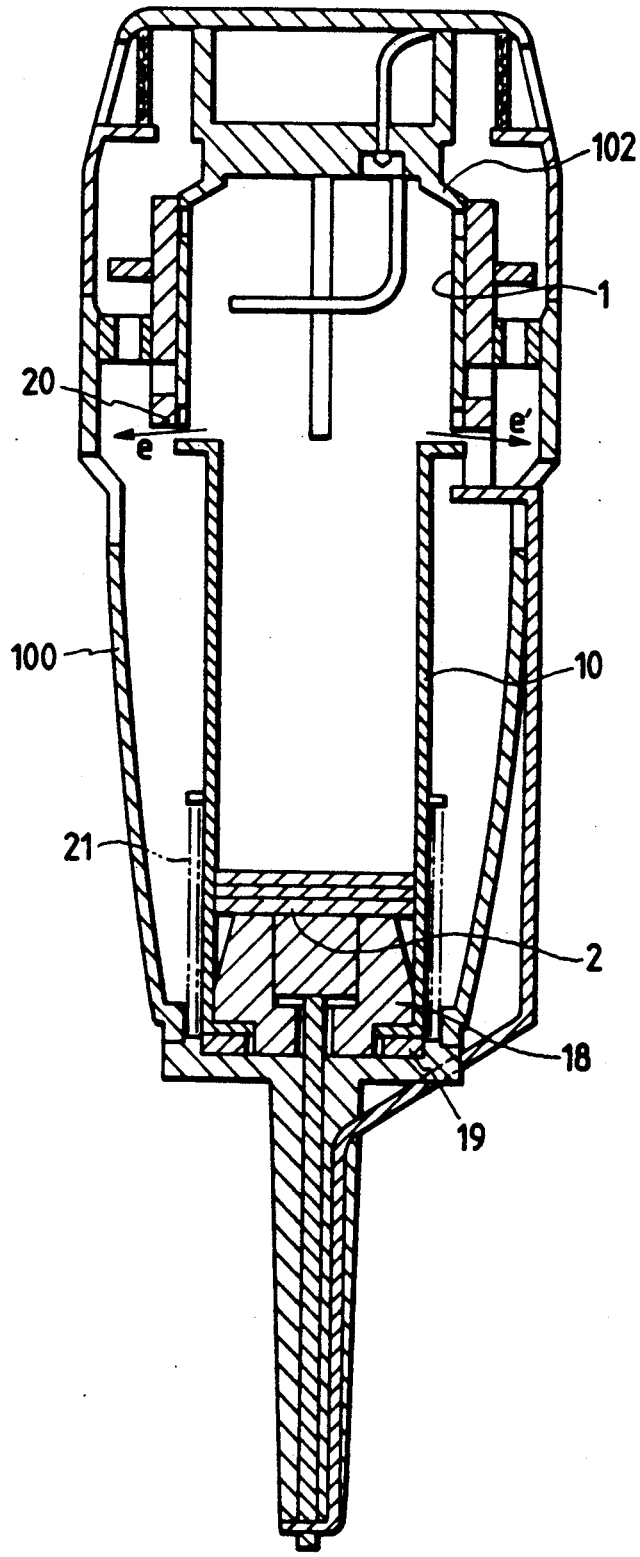
FIG. 6 is a longitudinal section view of the combustion gas powered nailer, which shows conditions where the piston reaches its bottom dead center.
Figure 7:
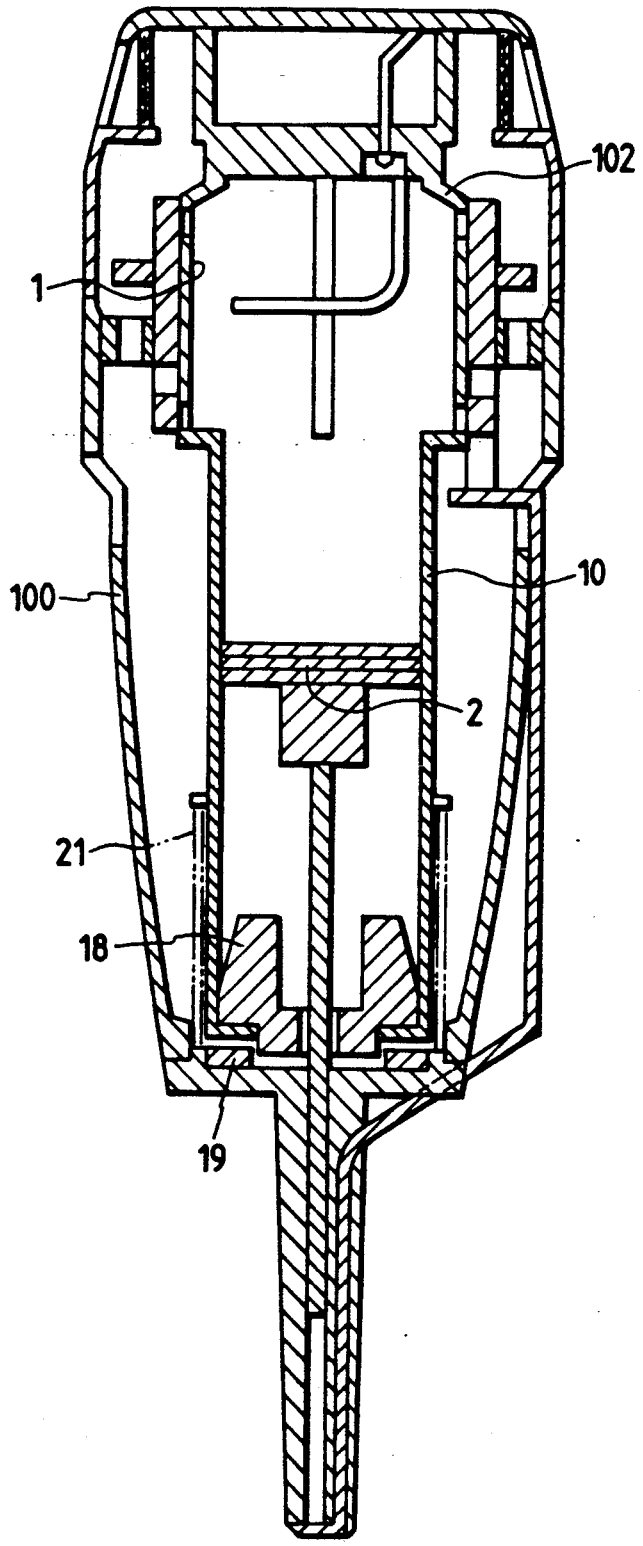
FIG. 7 is a longitudinal section view of the combustion gas powered nailer, which shows conditions where the piston assumes a position intermediate its top dead center and its bottom dead center during the return of the piston to its top dead center.

FIG. 6 shows a state at which the piston 2 assumes its bottom dead center. Immediately before the piston 2 reaches the bottom dead center, the piston 2 encounters a damper 18. Then, the piston 2, the damper 18, and the cylinder 10 move downward against the force of the spring 21 until the lower end of the cylinder 10 encounters a lower damper 19. When the lower end of the cylinder 10 encounters the lower damper 19, the piston 2 stops at its bottom dead center. During this process, as the cylinder 10 moves downward, the cylinder 10 separates from the cylinder head 102 so that a gap occurs between the cylinder 10 and the cylinder head 102. The gap between the cylinder 10 and the cylinder head 102 allows the burned gas to escape from the combustion chamber 1 as shown by the arrows e and e' in FIG. 6. The escape of the burned gas from the combustion chamber 1 drops the pressure in the combustion chamber 1 to an atmospheric level, so that the force of the spring 21 overcomes the pressure in the combustion chamber 1. Thus, the cylinder 10 is returned upward by the spring 21 and is brought into contact with the cylinder head 102 (see FIG. 7). As a result, the combustion chamber 1 is fully closed again. The burned gas remaining in the combustion chamber 1 cools and contracts, so that a vacuum is developed in the combustion chamber 1. The vacuum in the combustion chamber 1 returns the piston 2 toward its top dead center as shown in FIG. 7.

As shown in FIG. 1, the combustion chamber 1 is separated into the right-hand and left-hand halves 1*a* and 1*b* by the orifice grille 4 which extends parallel to the axis of the combustion chamber 1. The communication holes 6 for supplying the air to the combustion chamber 1 are exposed to the right-hand and left-hand halves 1*a* and 1*b* of the combustion chamber 1 respectively. In addition, the communication holes 7 for scavenging the burned gas from the combustion chamber 1 are exposed to the right-hand and left-hand halves 1*a* and 1*b* of the combustion chamber 1 respectively. Thus, the air can be easily supplied to both the right-hand and left-hand halves 1*a* and 1*b* of the combustion chamber 1, and the burned gas can be smoothly scavenged from both the right-hand and left-hand halves 1*a* and 1*b* of the combustion chamber 1. Specifically, the air supply and the burned-gas scavenging for the right-hand half 1*a* of the combustion chamber 1 are executed independently of the air supply and the burned-gas scavenging for the left-hand half 1*b* of the combustion chamber, and therefore the orifice grille 4 does not essentially offer any resistances to the flows of the burned gas and the air during the scavenging process. Accordingly, it is possible to attain a reduced rate of the consumption of an electric power driving the scavenging fan.

Figure 5:
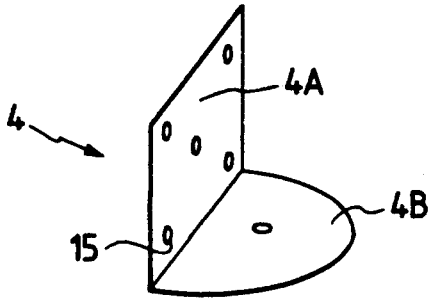
FIG. 5 is a perspective view of a modified orifice grille.

FIG. 5 shows a modified orifice grille 4 which includes a first section 4A and a second section 4B. The first section 4A corresponds to the orifice grille of FIG. 4. The second section 4B is connected to the lower edge of the first section 4A, and extends perpendicular to the axis of the combustion chamber 1. When the piston 2 is moved downward by the burning pressure, the second section 4B serves to prevent unburned gas from passing through a spacing between the lower edge of the orifice grille 4 and the piston 2.

DESCRIPTION OF THE SECOND PREFERRED EMBODIMENT

Figure 8:
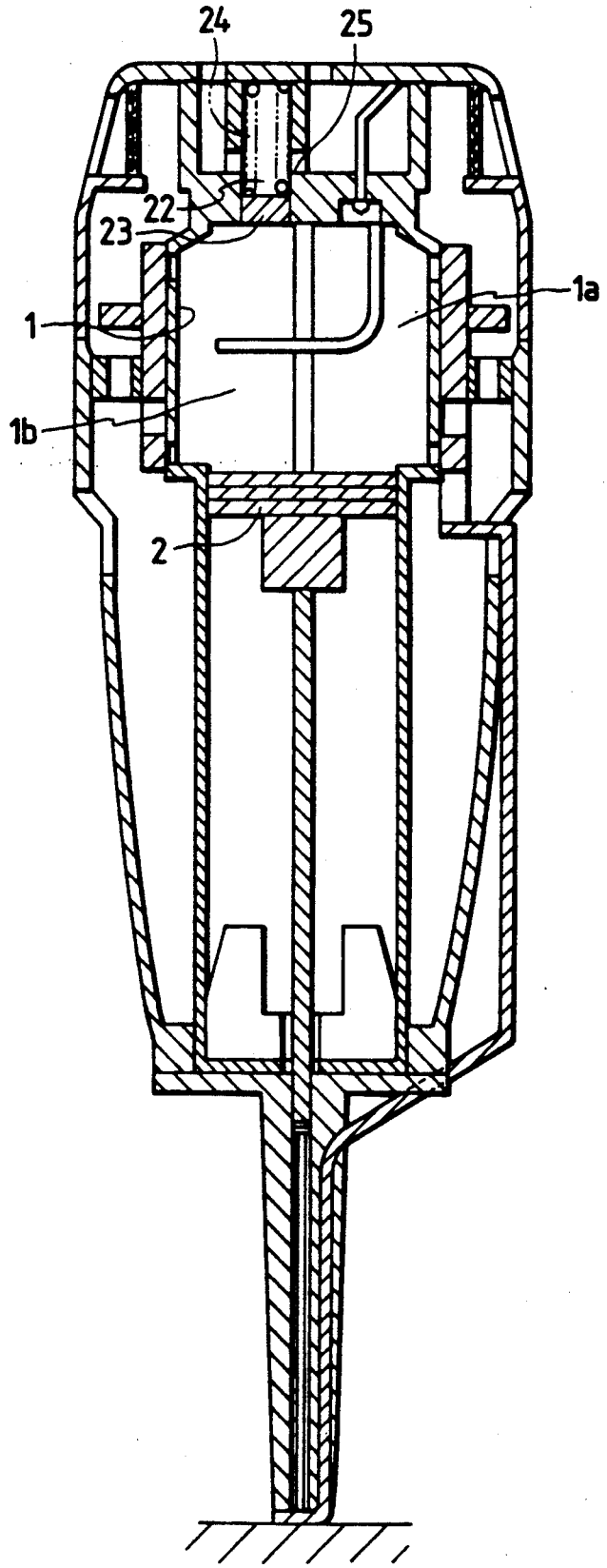
FIGS. 8 and 9 are longitudinal section views of a combustion gas powered nailer in different states according to a second embodiment of this invention.
Figure 9:
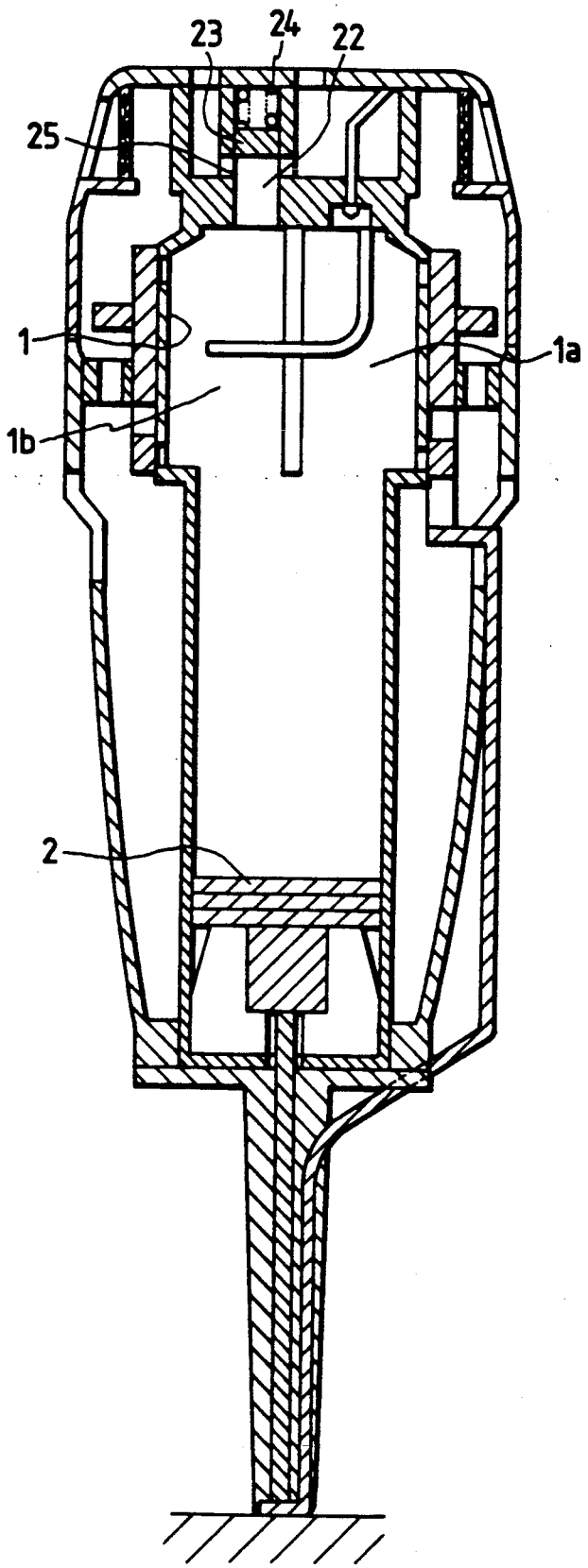

FIGS. 8 and 9 show a second embodiment of this invention which is similar to the embodiment of FIGS. 1-7 except for design changes indicated hereinafter.

The embodiment of FIGS. 8 and 9 includes a small cylinder 22 extending above a left-hand half 1*b* of a combustion chamber 1. A small piston 23 is slidably disposed within the small cylinder 22. A spring 24 extending within the small cylinder 22 urges the small piston 23 downward. The small cylinder 22 has side slits or exhaust openings 25 leading to atmosphere.

In the embodiment of FIGS. 8 and 9, a main cylinder 10 is fixed relative to a cylinder head 102, and a spring 21 (see FIG. 1) is omitted.

Immediately before combustion starts, the piston 23 assumes its lowest position as shown in FIG. 8 in which an upper surface and a lower surface of the small piston 23 are subjected to an atmospheric pressure and a pressure within the left-hand half 1*b* of the combustion chamber 1 respectively. As the combustion starts, the pressure within the combustion chamber 1 increases and a main piston 2 moves downward. Simultaneously, the small piston 23 moves upward against the force of the spring 24. When the main piston 2 approximately reaches its bottom dead center, the small piston 23 reaches its highest position as shown in FIG. 9. In this state, the small piston 23 lies above the side slits 25 so that burned gas escapes from the combustion chamber 1 to atmosphere via the side slits 25. As a result, the pressure within the combustion chamber 1 drops to the atmospheric level, and the small piston 23 is returned to its lowest position by the force of the spring 24. Thus, the communication between the combustion chamber 1 and the atmosphere via the side slits 25 is blocked. The burned gas remaining in the combustion chamber 1 cools and contracts, so that a vacuum is developed in the combustion chamber 1. The vacuum in the combustion chamber 1 returns the piston 2 toward its top dead center.

What is claimed is:

1. A combustion gas powered tool comprising:

a member defining a part of a cylindrical combustion chamber having an axis;

a piston movable in a direction along the axis of the combustion chamber, the piston defining the combustion chamber in conjunction with the member;

means for generating a mixture of air and fuel in the combustion chamber;

means for igniting the air-fuel mixture in the combustion chamber to drive the piston; and an orifice grille extending in the combustion chamber and being parallel to the axis of the combustion chamber.

2. A combustion gas powered tool comprising:

a cylinder head defining a part of a cylindrical combustion chamber having an axis;

a piston being movable in a direction along the axis of the combustion chamber and defining the combustion chamber in conjunction with the cylinder head;

a partition wall extending in parallel with the axis of the combustion chamber and dividing the combustion chamber into first and second sub chambers, the partition wall having at least one orifice via which the first and second sub chambers communicate with each other;

means for generating mixtures of air and fuel in the first and second sub chambers respectively;

means for igniting the air-fuel mixture in the first sub chamber to burn the air-fuel mixture in the first sub chamber, wherein a pressure increase by burning of the air-fuel mixture forces an unburned portion of the air-fuel mixture from the first sub chamber into the second sub chamber via the orifice, and the orifice functions to provide turbulences in the air-fuel mixture in the second sub chamber, and wherein burning of the air-fuel mixture propagates into the second sub chamber via the orifice; and means for supplying air to the first and second sub chambers and scavenging burned gas from the first and second sub chambers, the supplying and scavenging means including means for executing the air supplying and the burned-gas scavenging on the first sub chamber separately from the air supplying and the burned-gas scavenging on the second sub chamber so that the partition wall is prevented from providing a significant resistance to said supplying the air and said scavenging the burned gas.

3. A combustion gas powered tool comprising:

a member defining a part of a combustion chamber;

a piston movable in a predetermined direction and defining the combustion chamber in conjunction with the member;

means for generating a mixture of air and fuel in the combustion chamber;

means for igniting the air-fuel mixture in the combustion chamber to drive the piston; and an orifice grille extending in parallel with the predetermined direction of movement of the piston.

4. A combustion gas powered tool comprising:

a member defining a part of a cylindrical combustion chamber having an axis;

a piston movable in a direction along the axis of the combustion chamber, the piston defining the combustion chamber in conjunction with the member;

means for generating a mixture of air and fuel in the combustion chamber;

means for igniting the air-fuel mixture in the combustion chamber to drive the piston; and an orifice grille extending in the combustion chamber and being parallel to the axis of the combustion chamber, the orifice grill having holes to provide turbulences in the combustion chamber to promote combustion of the air-fuel mixture.

5. A combustion gas powered tool comprising:

a member defining a part of a combustion chamber;

a piston movable in a predetermined direction and defining the combustion chamber in conjunction with the member;

means for generating a mixture of air and fuel in the combustion chamber;

means for igniting the air-fuel mixture in the combustion chamber to drive the piston; and an orifice grille extending in parallel with the predetermined direction of movement of the piston, the orifice grille having holes to provide turbulences in the combustion chamber to promote combustion of the air-fuel mixture.

* * * * *